US005509812A

United States Patent [19]

Comerci et al.

[11] Patent Number: 5,509,812

[45] Date of Patent: Apr. 23, 1996

[54] CABLE TAP ASSEMBLY

[75] Inventors: Joseph D. Comerci, Elmhurst; Robert DeRoss, Naperville; Mark M. Data, Bolingbrook, all of Ill.

[73] Assignee: Molex Incorporated, Lisle, Ill.

[21] Appl. No.: 262,802

[22] Filed: Jun. 20, 1994

[51] Int. Cl.[6] ..... H01R 9/09

[52] U.S. Cl. ..... 439/76.1; 439/456; 439/658

[58] Field of Search ..... 439/76, 540, 535, 439/456, 459, 465, 467, 404, 405, 658

[56] References Cited

U.S. PATENT DOCUMENTS

| | | | |
|---|---|---|---|
| 4,225,205 | 9/1980 | Sinclair et al. | 439/499 |
| 4,286,835 | 9/1981 | Adams et al. | 439/493 |
| 4,758,536 | 7/1988 | Miller et al. | 439/138 |
| 4,894,024 | 1/1990 | Debortoli et al. | 439/535 |
| 4,997,388 | 3/1991 | Dale et al. | 439/404 |
| 5,174,782 | 12/1992 | Bogiel et al. | 439/404 |
| 5,188,541 | 2/1993 | Comerci et al. | 439/596 |
| 5,290,175 | 3/1994 | Robinson et al. | 439/540.1 |

*Primary Examiner*—Neil Abrams
*Attorney, Agent, or Firm*—Stephen Z. Weiss

[57] ABSTRACT

A cable tap assembly includes a housing having a mating face (28) and an opposite terminating face (26). A plurality of terminals (32, 40) are mounted in the housing. Each terminal includes a mating portion engageable through the mating face of the housing with a complementary mating terminal, and a terminating portion generally at the terminating face of the housing. A wiring assembly, such as a printed circuit board (16), is mounted on the terminating face of the housing and includes a plurality of connectors (18–20) electrically couples thereto. The connectors are adapted to receive conductors of at least one multi-conductor electrical cable (88). A strain relief cover (22) and cap (24) assembly is mountable at the terminating face of the housing, over the wiring apparatus, and is adapted to hold and provide strain relief for the cable.

2 Claims, 4 Drawing Sheets

CABLE TAP ASSEMBLY

FIELD OF THE INVENTION

This invention generally relates to the art of electrical connectors and, particularly, to an electrical cable tap system or assembly for making tap, branch or butt connections to conductors of an electrical cable or cables.

BACKGROUND OF THE INVENTION

Electrical cable tap, branch or butt connectors are known for selectively connecting each of a plurality of tap terminals or contacts to each of a plurality of conductors in a multi-conductor cable according to a predetermined wiring scheme. The tap terminals usually are contained in a connector housing and, often, include insulation displacement portions for termination to the cable conductors by piercing the insulation of the cable upon closing of the tap connector.

One typical use for such connectors is in the wiring system for buildings wherein the system incorporates power, data and/or analog signals in a single system. In other words, for years, buildings, such as office buildings and residences, have had numerous separate electrical distribution systems. The distribution of power within buildings was unchanged for a very long period of time. However, a number of other electrical distribution systems have increasingly been employed within buildings. For example, data communications systems, telecommunications systems, audio and/or visual communications systems, and other power distribution systems may be present in a contemporary building, such as a typical residence.

Rather than allowing buildings to continue to employ such a large number of electrical distribution systems, attempts have been made to use certain cable configurations that combine power and data transmission conductors. Such a cable configuration most often has been in the form of a multi-conductor flat cable. Sometimes the flat cable is rolled into a generally cylindrical configuration and surrounded by a generally tubular shielding foil running the length of the cable. A variety of generally flat electrical connector assemblies have been designed for making tap, branch or butt connections to the conductors of such hybrid flat electrical cables that include both power and data transmission conductors. Some examples of such connector assemblies are shown in U.S. Pat. No. 5,174,782 to Bogiel et al, dated Dec. 29, 1992, and U.S. Pat. No. 5,188,541 to Comerci et al, dated Feb. 23, 1993, both of which are assigned to the assignee of this invention, as well as U.S. Pat. No. 4,758,536 to Miller et al, dated Jul. 19, 1988, and U.S. Pat. No. 4,997,388 to Dale et al, dated Mar. 5, 1991.

Problems now have been encountered in using hybrid cables incorporating both power and data transmission conductors, involving interference or "cross-talk" between the conductors. This is true with the flat hybrid cables described above. Attempts now have been made to go back to separate cables for separate electrical power and data transmission functions. This has caused considerable consternation in the industry, because extensive hardware has been designed to accommodate the generally flat tap, branch or butt connectors which have been designed for use with the flat hybrid cables. The present invention is directed to solving these problems by providing a new and improved cable tap assembly which has an overall envelope quite similar to the connectors presently designed for hybrid flat cables but which can interconnect separate or discrete cables that have different spacings, different conductor orders and the like.

SUMMARY OF THE INVENTION

An object, therefore, of the invention is to provide a new and improved cable tap assembly of the character described.

In the exemplary embodiment of the invention, the cable tap assembly generally includes a housing having a mating face and an opposite terminating face. A plurality of terminals are mounted in the housing. Each terminal includes a mating portion engageable through the mating face of the housing with a complementary mating terminal and a terminating portion generally at the terminating face of the housing. A wiring assembly is mounted on the terminating face of the housing and includes a plurality of connectors electrically connected thereto. The connectors are adapted to receive conductors of at least one multi-conductor electrical cable. Strain relief means are mountable at the terminating face of the housing and adapted to hold and provide strain relief for the cable.

As disclosed herein, the terminating face of the housing is generally planar, and the wiring assembly is provided by a printed circuit board. The terminating portions of the terminals project into holes in the printed circuit board and are electrically coupled to circuit traces on the board. The connectors are mounted on the printed circuit board and include connector terminals coupled to the circuit traces on the printed circuit board.

A generally planar dielectric cover is provided for the printed circuit board. A cap is provided for cooperation with the cover to sandwich the cable between the cap and the cover to provide the strain relief means for the cable. At least one of the cap or the cover includes groove means for receiving the cable therein.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
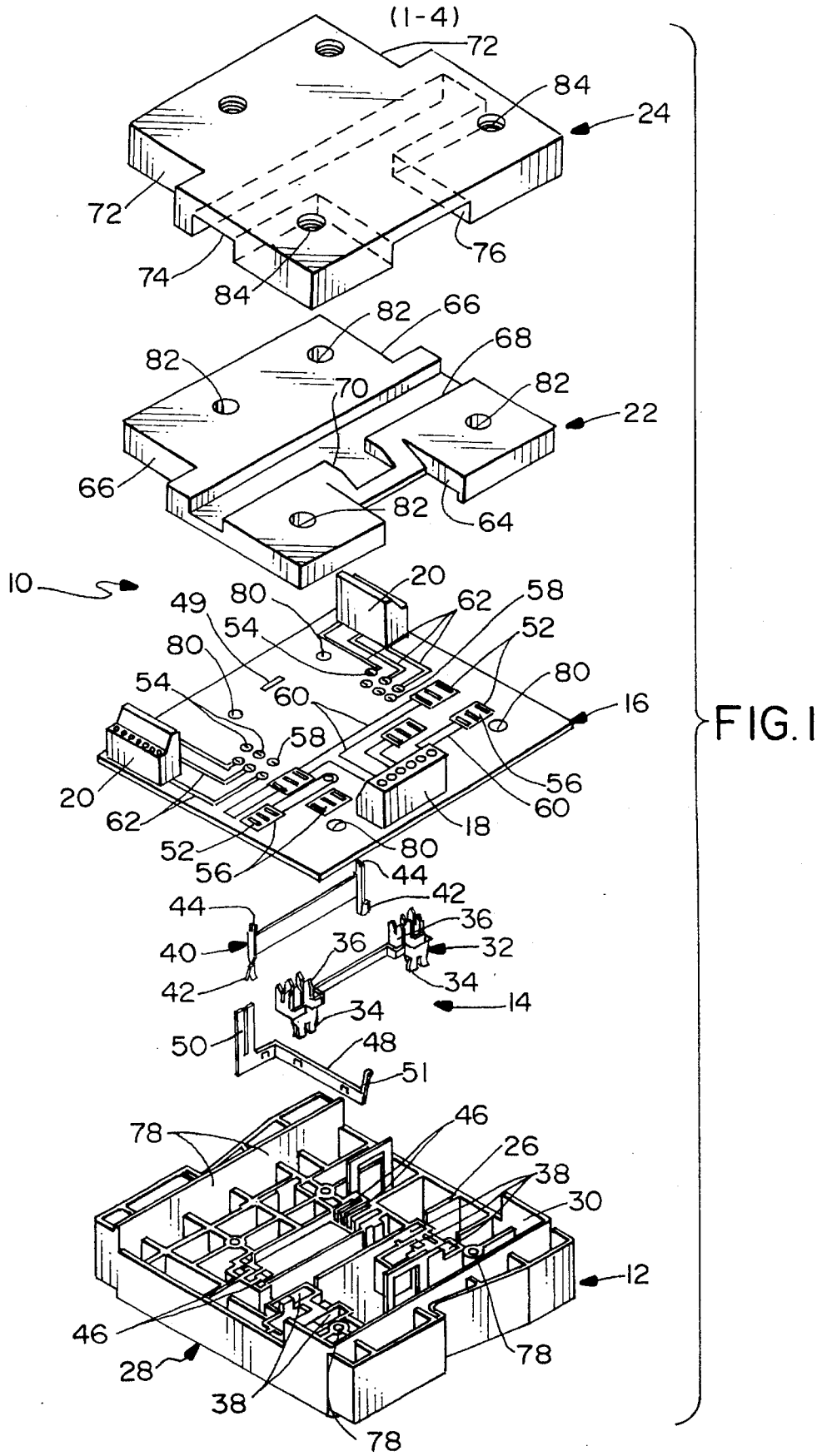
FIG. 1 is an exploded perspective view of a cable tap assembly embodying the concepts of the invention.

Referring to the drawings in greater detail, and first to FIG. 1, the invention is embodied in a cable tap assembly, generally designated 10, which includes a generally flat housing, generally designated 12; a plurality of terminals, generally designated 14, mounted in the housing; a wiring assembly in the form of a printed circuit board, generally designated 16, that mounts a plurality of connectors 18 and 20; a flat cover, generally designated 22; and a flat cap, generally designated 24. Housing 12 and terminals 14 are known and are shown in the aforementioned U.S. Pat. No. 5,174,782 which is incorporated herein by reference. Although cable tap assembly 10 is described herein as a tap assembly or connector, it should be understood that the invention is applicable for use as a branch or butt connector, and the term cable "tap" assembly is used herein generically.

Housing 12 is generally rectangular or square and has a cable terminating face 26 and an opposite mating face 28. Actually, terminating face 26, as seen in FIG. 1, is recessed within side walls 30 of the housing to provide a recess area for receiving printed circuit board 16.

Terminals 14 are mounted within housing 12 and originally were designed for insulation-displacing termination with the power and data conductors of a multi-conductor hybrid cable. More particularly, a power terminal, generally designated 32, includes mating contact portions 34 and terminating portions 36. Although there are three such power terminals 32, only one is shown in the drawings. Mating contact portions 34 are press-fit into a plurality of sockets 38 in housing 12. Terminating portions 36 project upwardly from terminating face 26 of the housing.

Similarly, a plurality of data terminals (only one is shown in the drawings), generally designated 40, include mating portions 42 and terminating portions 44. The mating portions are press-fit into sockets 46 in housing 12, and terminating portions 44 project upwardly from terminating face 26 of the housing.

Lastly, a "bridging" conductive member, generally designated 48, may be provided for receiving a ground conductor. The bridging member 48 has terminating portion 50 for engaging appropriate ground circuit trace 49 on printed circuit board 16 and a contact portion 51 for engaging a side of a power terminal 32 connected to the power ground circuit.

Printed circuit board 16 is rectangular or square and is sized for fitting within the recessed area defined by side walls 30 of housing 12 and for positioning onto terminating face 26 of the housing. The printed circuit board has appropriate apertures 52 for receiving terminating portions 36 of power terminals 32, along with apertures 54 for receiving terminating portions 44 of data terminals 40. Circuit pads 56 surround apertures 52, and circuit pads 58 surround apertures 54. Circuit traces 60 interconnect circuit pads 56 to the terminals of power connector 18, and circuit traces 62 interconnect circuit pads 54 with the terminals of data connectors 20.

Figure 2:
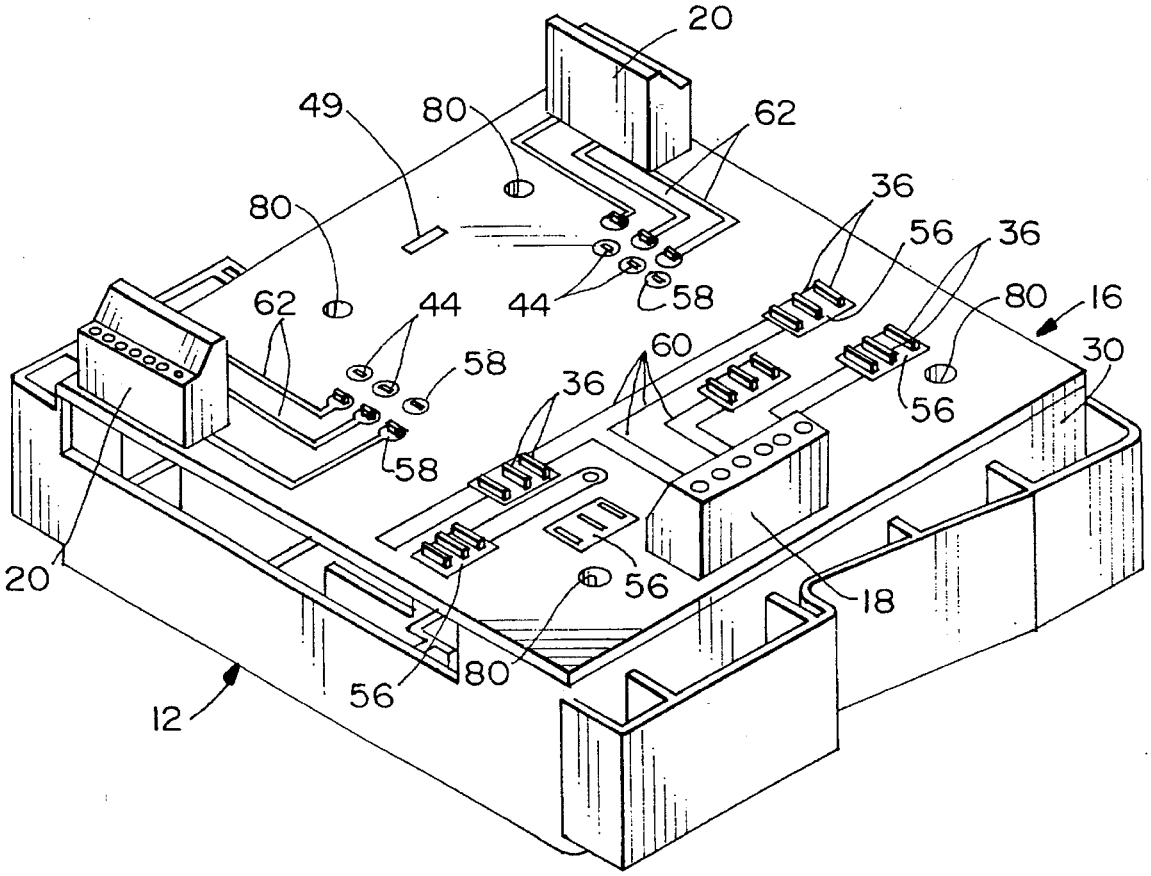
FIG. 2 is a perspective view of the housing of the assembly with the printed circuit board and connectors mounted thereon.

Therefore, referring to FIG. 2 in conjunction with FIG. 1, when printed circuit board 16 is mounted within the recessed area of housing 12 as seen in FIG. 2, solder connections can be made between terminating portions 36 of the power terminals to circuit pads 56, and terminating portions 44 of the data terminals can be solder connected to circuit pads 58. This, in turn, electrically couples the terminating portions of the power terminals within housing 12 to the terminals within power connector 18, and electrically couples the terminating portions of the data terminals within housing 12 to the terminals within data connectors 20.

Dielectric cover 22 is designed to fit on top of circuit board 16 to cover the terminations on the top of the printed circuit board, as described immediately above. The cover 22 has an edge cut-out area 64 for accommodating power connector 18 and a pair of corner cut-out areas 66 for accommodating data connectors 20. The top of the cover includes an elongated groove 68 that extends completely across the cover, along with a short branch groove 70, all for purposes described hereinafter.

Cap 24, like cover 22, is generally flat and includes a pair of corner cut-out areas 72 to accommodate wires projecting from data connectors 20, as will be seen hereinafter. The cap also includes an elongated groove 74 on the underside thereof for alignment with groove 68 of cover 22, along with a branch groove 76 for alignment with groove 64 in the cover.

Figure 3:
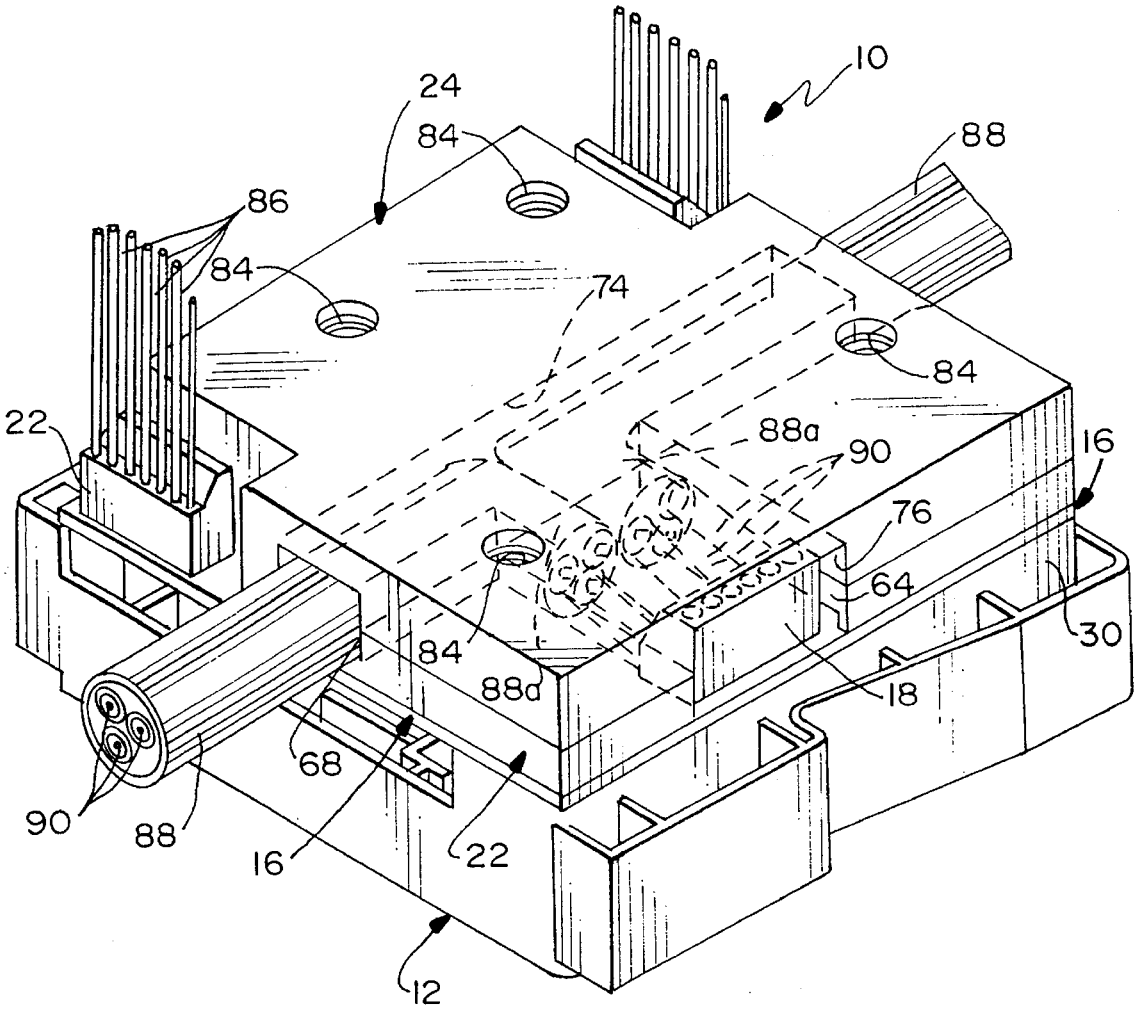
FIG. 3 is a perspective view of the cable tap assembly in assembled condition coupled to a plurality of electrical cables.

As seen in FIG. 1, housing 12 has a plurality (four) of holes 78, printed circuit board 16 has four holes 80, cover 22 has four holes 82 and cap 24 has four holes 84. When the housing, printed circuit board, cover and cap are in assembled condition (see FIG. 3), the four holes in each of the respective components are aligned for receiving appropriate fastening means to hold the components in assembled condition. For instance, bolts may be inserted upwardly through holes 78 in housing 12 and threaded into holes 84 of cap 24. FIG. 3 clearly shows the internal threading of holes 84, and the internal threading may be provided by separate internally threaded inserts.

FIG. 3 shows cable tap assembly 10 in its assembled condition. A plurality of discrete electrical cables or conductors 86 are terminated to the terminals within data connectors 20. These conductors may be signal conductors for various data communications systems, telecommunications systems, audio and/or visual communications system and the like. The ends of a pair of power cables 88 are positioned within opposite ends of grooves 74 in cap 24 and 68 in cover 22. The cable ends are bent, as at **88*a*, into branch grooves 70 in the cover and 76 in the cap. Each cable includes a plurality (three) of power conductors 90 which are terminated to the terminals within power connector 18. It can be seen clearly in FIG. 3 that cover 22 and cap 24 provide a strain relief means for clamping power cables 88 within the T-shaped groove configuration provided by grooves 68 and 70 in the cover and grooves 74 and 76** in the cap.

Figure 4:
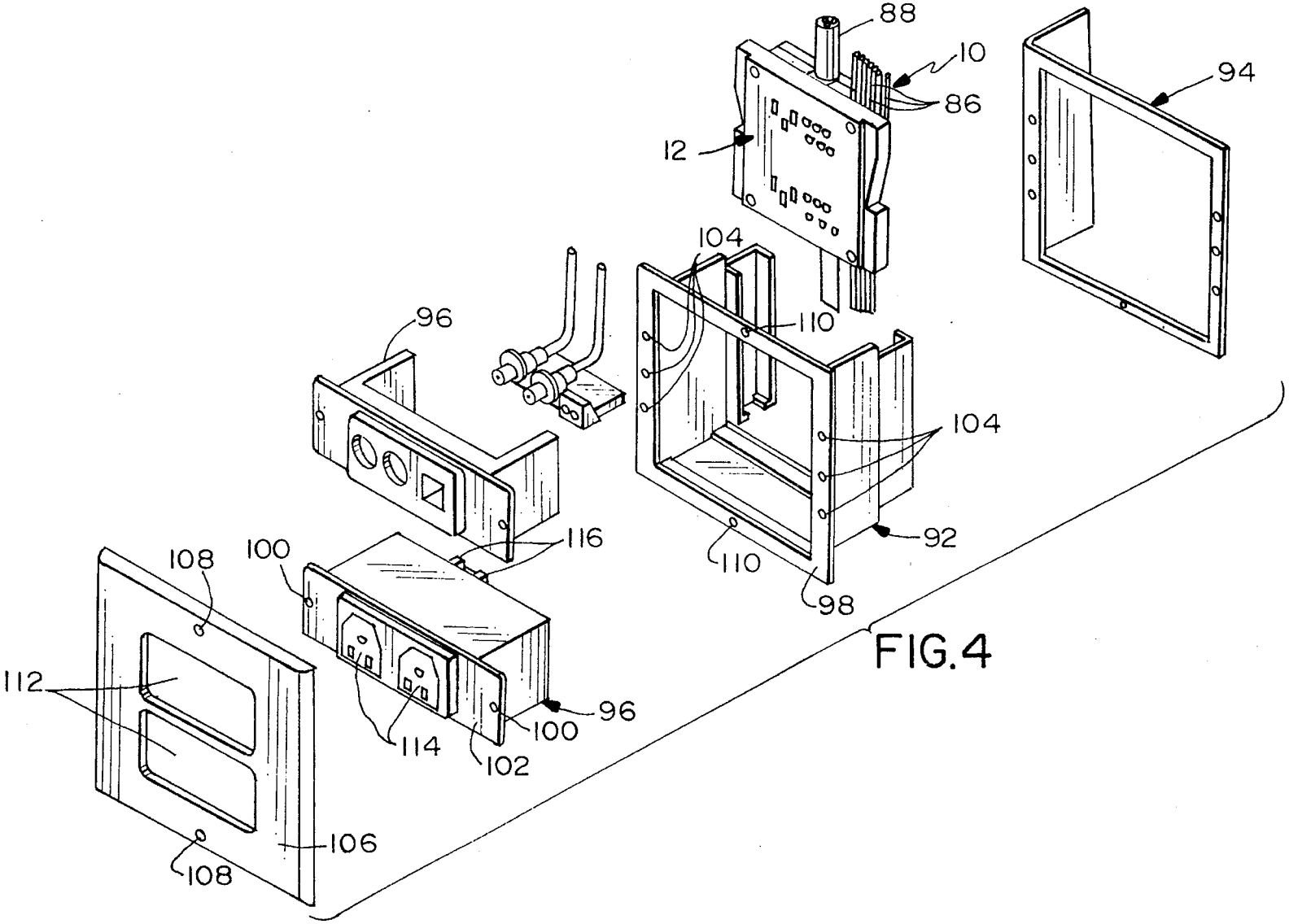
FIG. 4 is an exploded perspective view of the cable tap assembly in combination with a wall or panel mounted receptacle assembly in which the cable tap assembly of the invention may be incorporated.

FIG. 4 shows cable tap assembly 10 in a receptacle assembly for mounting in a wall, panel or like structure. The components of the assembly are shown somewhat schematically, simply to illustrate an applicable use of cable tap assembly 10 of the invention. The receptacle assembly is similar to that shown in the aforementioned U.S. Pat. No. 5,188,541 which is incorporated herein by reference.

More particularly, the receptacle assembly includes a receptacle box, generally designated 92, which may be mounted in an appropriate aperture in a wall or panel by means of a mounting bracket, generally designated 94. One or more receptacle blocks, generally designated 96, are mounted to a peripheral front flange 98 of receptacle box 92 by fasteners extending through apertures 100 in a front flange 102 of each receptacle block 96 and apertures 104 in peripheral flange 98 of receptacle box 92. A face plate 106 covers the front of the assembly and is fastened by appropriate means to peripheral front flange 98 of receptacle box 92 by means of apertures 108 in the face plate and apertures 110 in peripheral flange 98. Openings 112 are provided in the face plate in alignment with receptacles 114 of the receptacle block. Receptacles 114 have openings or apertures for receiving the prongs of conventional electric plugs for power. Portions 116 of the power contacts of the receptacles are shown projecting out the back side of receptacle block 96 for insertion into openings in the housing 12 of cable tap assembly 10. Generally, cable tap assembly 10 establishes tap or branch connections with the conductors of cables 86 and 88 (FIG. 3). The receptacle assembly shown in FIG. 4 shows an applicable use of the cable tap assembly for mating with various power and data receptacle blocks 96.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A cable tap assembly, comprising:

a housing having a mating face and an opposite generally planar terminating face;

a plurality of terminals mounted in the housing, each terminal including a mating portion engageable through the mating face of the housing with a complementary mating terminal and a terminating portion generally at the terminating face of the housing;

a wiring assembly, including a printed circuit board, mounted on the terminating face of the housing and including connectors electrically coupled, and mounted to the printed circuit board, the terminating portions of the terminals projecting into holes in printed circuit board and electrically coupled to circuit traces on the printed circuit board, the connectors being adapted to receive conductors of at least one multi-conductor electrical cable; and strain relief means, separate from the housing and comprising a dielectric cover and cap for sandwiching the cable between the cover and cap, mountable at the terminating face of the housing and adapted to hold and provide strain relief for the cable.

2. The cable tap assembly of claim 1 wherein at least one of the cap and the cover include grooves for receiving the cable therein.

* * * * *